US005553978A

United States Patent [19]

Bates

[11] Patent Number: 5,553,978

[45] Date of Patent: Sep. 10, 1996

[54] PILING ANCHOR

[76] Inventor: Stanley Bates, P.O. Box 43, Point Washington, Fla. 32454

[21] Appl. No.: 429,216

[22] Filed: Apr. 25, 1995

[51] Int. Cl.[6] ..... E02D 5/74

[52] U.S. Cl. ..... 405/244; 52/153

[58] Field of Search ..... 405/244, 259.1; 52/146, 153, 154, 155, 158, 162, 164

[56] References Cited

U.S. PATENT DOCUMENTS

| | | | |
|---|---|---|---|
| 744,421 | 11/1903 | Small | 52/162 |
| 825,158 | 7/1906 | Rousseu et al. | 52/164 |
| 856,003 | 6/1907 | Thomas . | |
| 912,018 | 2/1909 | McNutt | 52/164 |
| 1,218,238 | 3/1917 | Clark | 52/162 |
| 1,695,523 | 12/1928 | Bilhorn . | |
| 1,717,557 | 6/1929 | Halgrimson | 52/153 |
| 1,850,147 | 3/1932 | Aiken | 52/162 |
| 2,170,889 | 8/1939 | Allin | 52/164 |
| 2,204,924 | 6/1940 | Cappel . | |
| 2,633,947 | 4/1953 | Shiff . | |
| 2,873,829 | 2/1959 | Weigmann | 52/164 |
| 3,012,644 | 12/1961 | Bush . | |
| 3,017,000 | 1/1962 | Hynds | 52/164 |
| 3,763,655 | 10/1973 | Galuska . | |
| 4,023,314 | 5/1977 | Tanner . | |
| 4,160,613 | 7/1979 | Stanwick . | |
| 4,592,178 | 6/1986 | Lu | 405/248 X |
| 4,644,712 | 2/1987 | Watson | 52/162 |
| 4,733,994 | 3/1988 | Simantuntak . | |
| 4,813,816 | 3/1989 | Simantuntak . | |
| 4,889,451 | 12/1989 | Simantuntak . | |

*Primary Examiner*—Frank Tsay
*Attorney, Agent, or Firm*—David H. Semmes

[57] ABSTRACT

Expansible anchors, particularly a pivotable anchor for pilings. The anchor is characterized by a backing plate which is secured to the lower exterior portion of the piling. A pivot bracket extends laterally outward of the backing plate to support a pivoting arm and thrust plate. As the piling is being driven, the pivoting arm and thrust plate are pivoted upwardly in substantial alignment with the piling vertical axis. As the piling is driven and set, the pivoting arm and thrust plate are pivoted downwardly to a laterally outward locking mode. The surrounding marine surface then settles upon the thrust plate, locking the piling in place.

10 Claims, 4 Drawing Sheets

PILING ANCHOR

CROSS-REFERENCES TO RELATED APPLICATIONS

None.

BACKGROUND OF THE INVENTION

1. Field of the Invention

Embedding anchors, particularly an expansible anchor which may be secured to the sides of a piling being driven. As the piling is set, the anchor fluke is pivoted and set outwardly to engage the sides of the piling hole.

2. Description of the Prior Art

| | |
|---|---|
| THOMAS | 856,003 |
| BILHORN | 1,695,523 |
| CAPPEL | 2,204,924 |
| SCHIFF | 2,633,947 |
| BUSH | 3,012,644 |
| GALUSKA | 3,763,655 |
| TANNER | 4,023,314 |
| STANWICK | 4,160,613 |
| SIMANJUNTAK | 4,733,994 |
| SIMANJUNTAK | 4,813,816 |
| SIMANJUNTAK | 4,889,451 |

The afore-listed patents are being discussed within a subsequently filed Information Disclosure Statement.

SUMMARY OF THE INVENTION

The present embedding anchor for a piling is adapted for bolting to wood-treated pilings of the type that are used for docks, seawalls and boat houses. The anchor includes a backing plate which is affixed to the piling lower exterior by means of lug bolts or the like. A pivot bracket extends laterally outward of the backing plate and includes a pivoting arm which supports an 8"×8" thrust plate. As the piling is being driven, the thrust plate is supported upwardly in substantial alignment with the vertical axis of the piling. As the piling is set, the thrust plate is pivoted downwardly and laterally outward of the piling in a locking mode. As the piling hole refills with marine earth, the equivalent pressure of several tons of marine earth are applied to the locking plate. At this point, several thousand pounds of pressure are required to lift the pile, the embedding anchor serving as a safeguard from destruction of marine structures.

DESCRIPTION OF THE PREFERRED EMBODIMENTS

Figure 1:
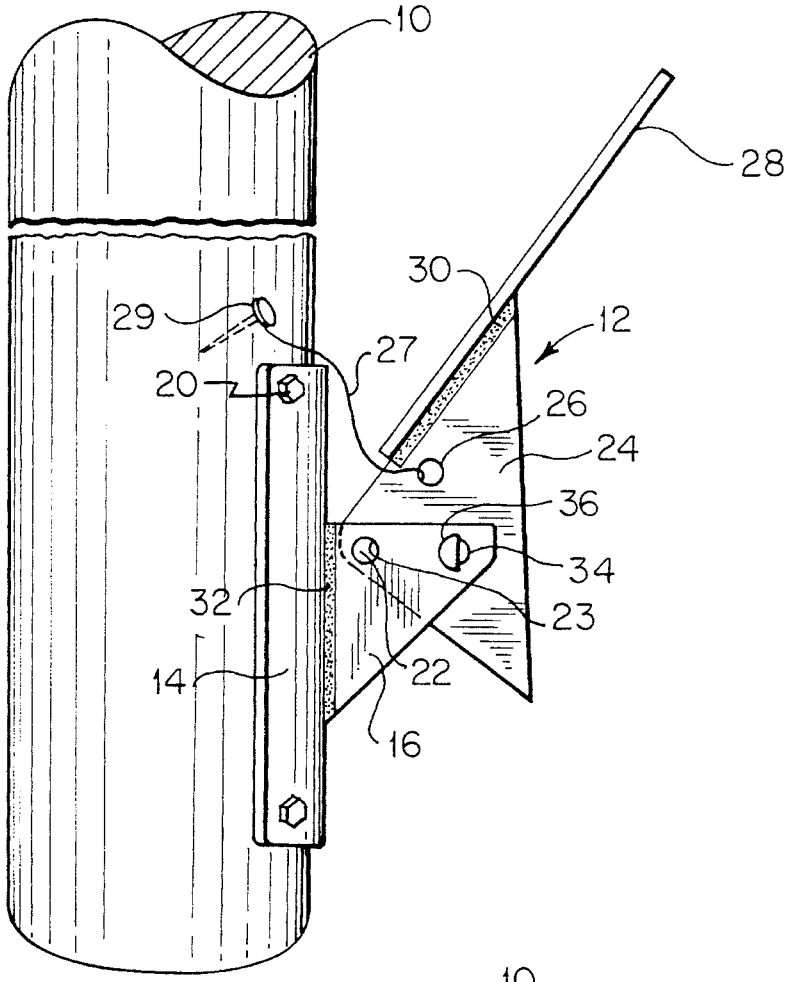
FIG. 1 is a partially fragmentary side elevation, showing the pivotable anchor for pilings with the thrust plate pivoted upwardly in a mode of substantial alignment with the piling.
Figure 2:
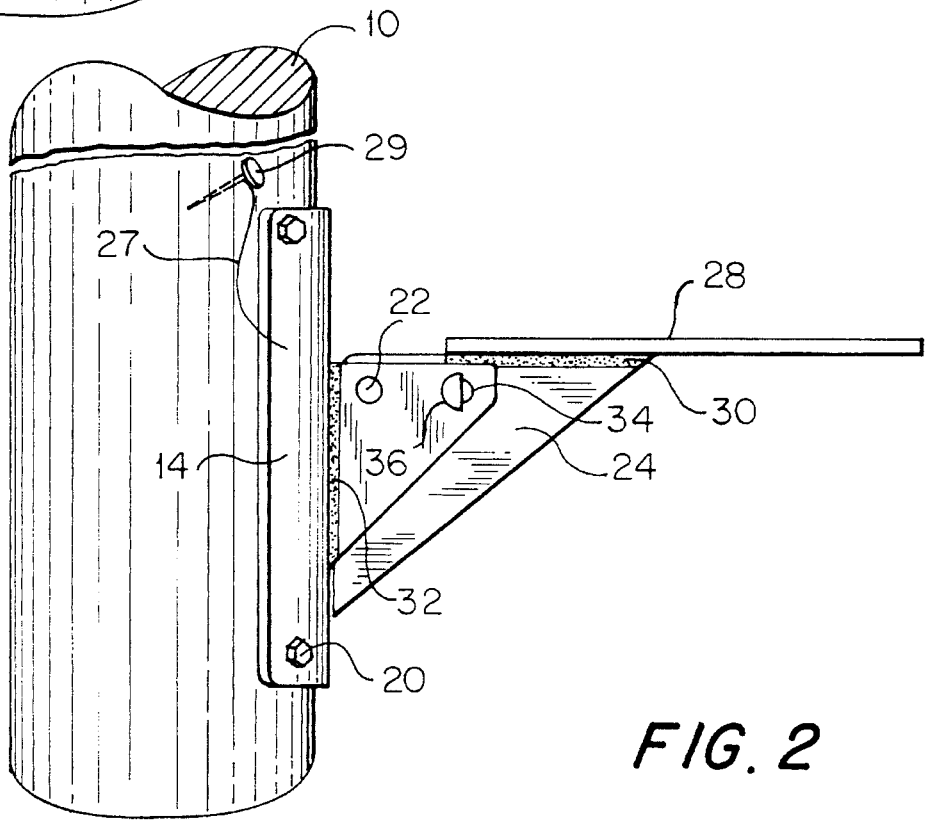
FIG. 2 is a side elevation showing the thrust plate pivoted downwardly and laterally outward in a locking mode.
Figure 3:
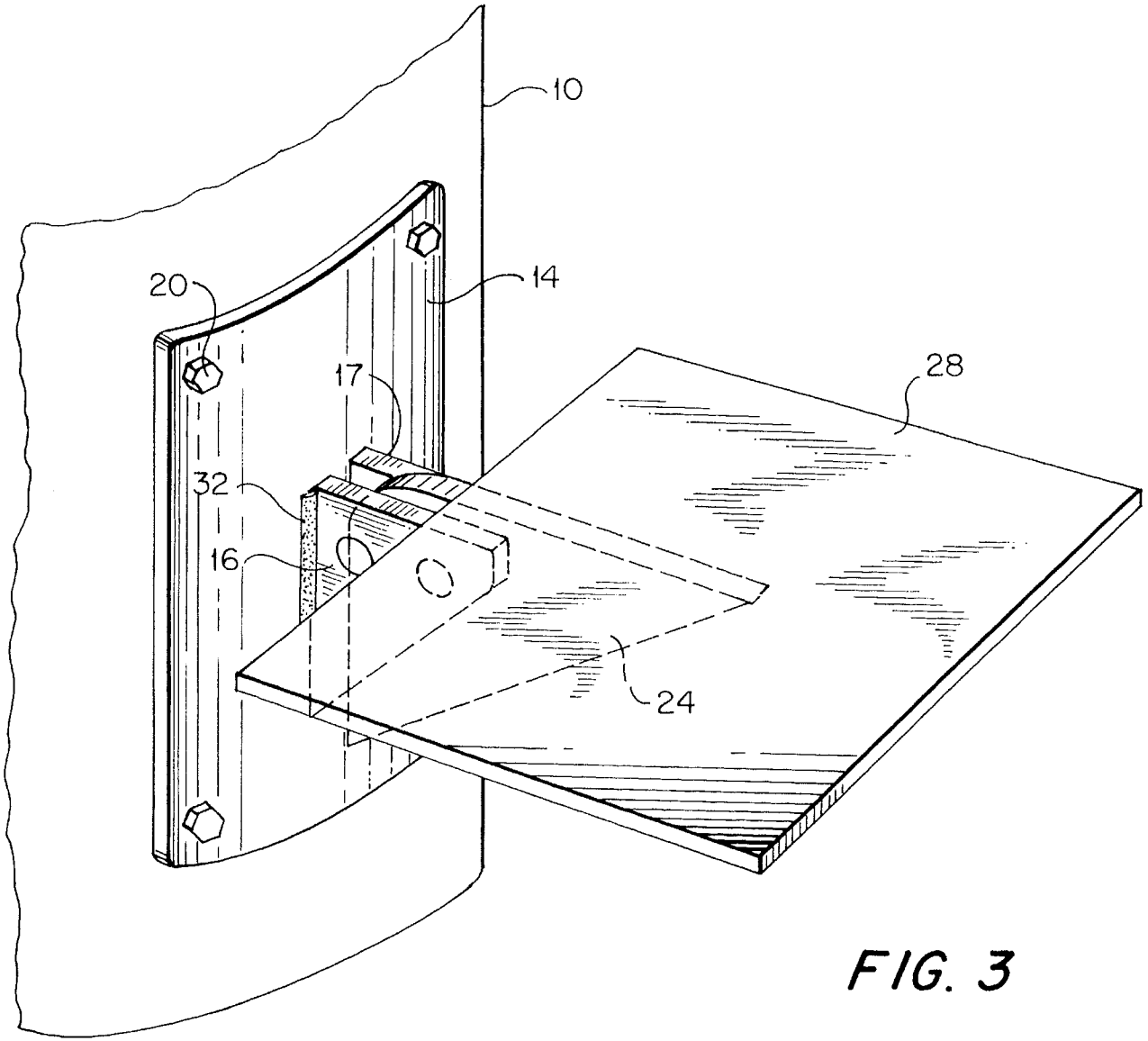
FIG. 3 is a perspective view of the thrust plate pivoted outwardly of the backing plate and in a locking mode.
Figure 4:
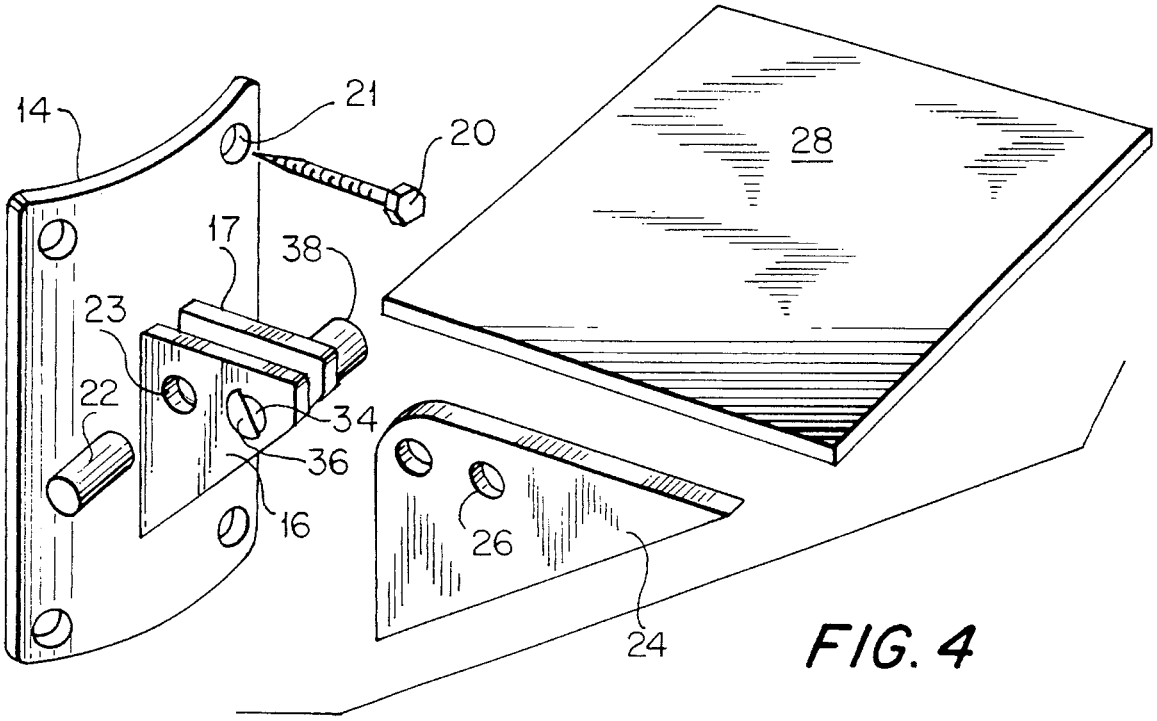
FIG. 4 is an exploded view (partially in phantom), showing the backing plate, pivot bracket, pivoting arm and thrust plate components.
Figure 5:
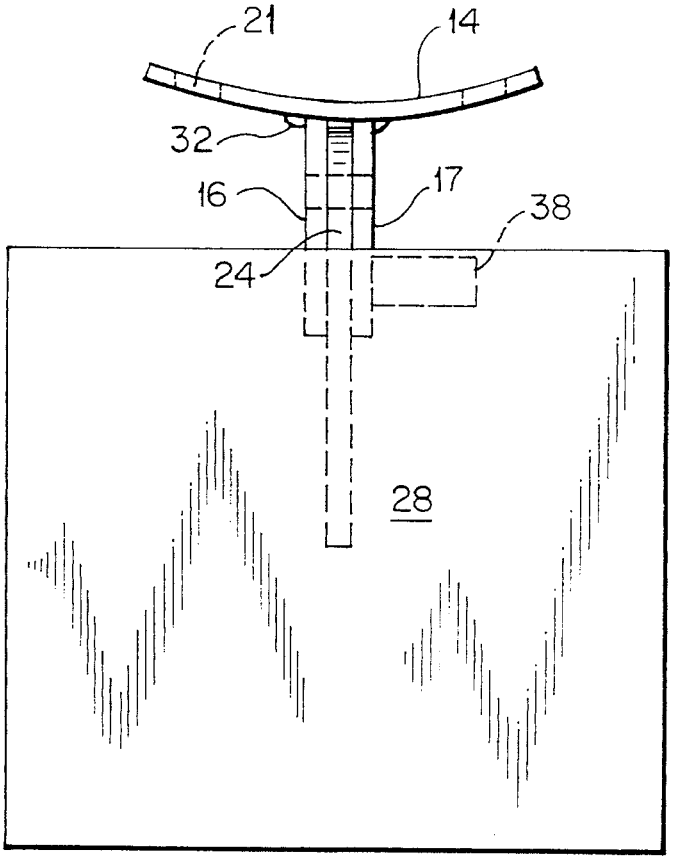
FIG. 5 is a top plan of the pivotable anchor.
Figure 6:
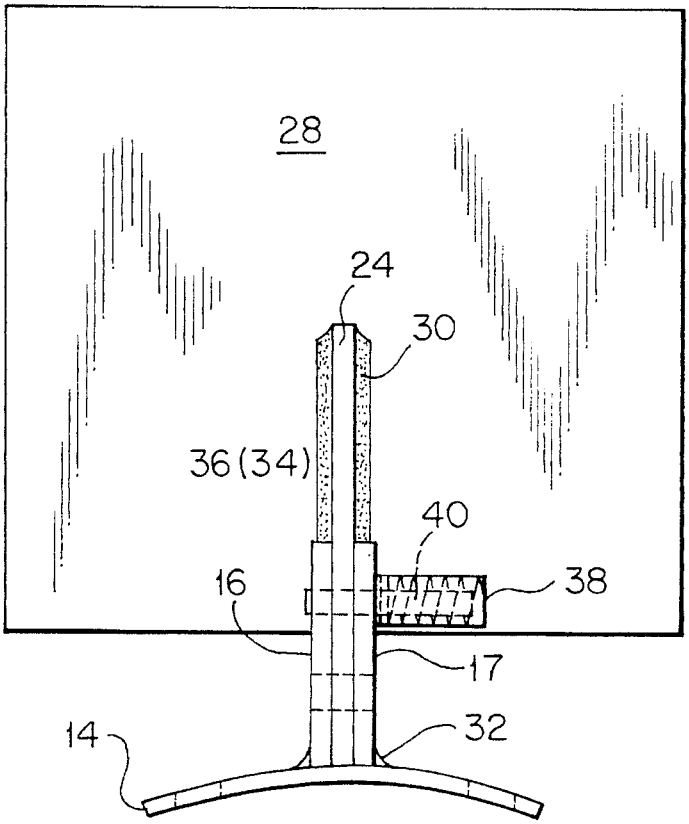
FIG. 6 is a bottom plan.
Figure 7:
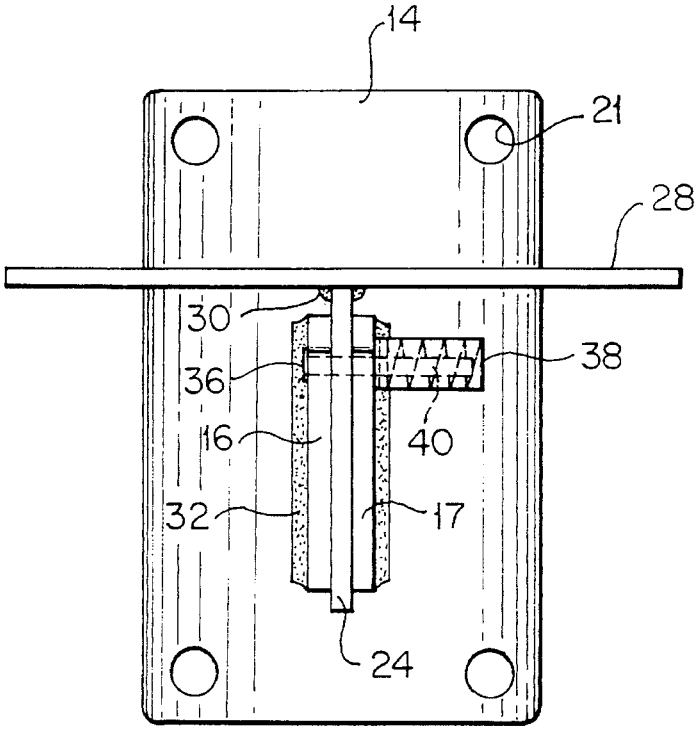
FIG. 7 is a front elevation of the locking anchor with the thrust plate pivoted laterally outward of the backing plate in a locking mode.

In FIG. 1, piling anchor 12 is shown as secured to the lower exterior surface of piling 10. Anchor 12 includes a curvate backing plate 14 which may be secured to the exterior surface of piling 10 by means of lag bolts 20 extending through apertures 21, A bifuracted pivot bracket 16, 17 extends laterally of backing plate 14 and is secured thereto by weldments 32, or the like. Bracket surfaces 16, 17 respectively, include aligned apertures 23 through which pivot pin 22 extends, so as to pivotably secure pivoting arm 24 to bracket 16.

Pivoting arm 24, also, includes locking aperture 26 and is secured to the underside of thrust plate 28 by means of weldments 30.

As pile 10 is being driven, pivoting arm 24 and thrust plate 28 are rotated upwardly in substantial alignment with the vertical axis of piling 10. In the pile driving mode illustrated in FIG. 1, thrust plate 20 is approximately 8° offset from the vertical axis of piling 10. If desired, thrust plate 28 may be secured in this alignment or driving mode by means of a string or tie 27, secured to a nail 29, or the like, driven into the exterior of the pile. As will be apparent, the driving of the pile tends to support the thrust plate in its upper driving mode. As the pile is set by lifting or jerking, tie 27 is broken and thrust plate 28 is pivoted downwardly and laterally outward into a locking mode. At this point, a spring-actuated detent 40 projects from detent housing 38, mounted upon bracket surface 17. Detent tip 34 extends through aperture 26 in pivoting arm 24 and into aperture 34 within pivoting arm 24. As will be noted, aperture 34 may be partially covered with a metallic, half moon lug 36 to limit movement of the detent tip 34.

Conventionally, pilings are set by means of a three inch jet pump, such as the Briggs & Stratton product trademarked "Red Devil" which develops 125 psi, while delivering 300 gallons per minute to blow a hole in the marine surface beneath the lower end of the pile. As the piling is set or lifted, the thrust plate 28 pivots laterally outward, such that the detent tip 34 locks within bracket hole 36. The surrounding marine earth engages the piling lower end, covering thrust plate 28 and thereby locking the piling into six to seven feet of mud. This locking has the effect of securing the piling by a ten-foot diameter of marine earth.

Thus, a low cost piling anchor is provided which elminates the need for complicated flukes and fluke actuating means, as well as the necessity for setting with concrete, or inner telescoping lugs.

I claim:

1. A piling anchor comprising:

a. a backing plate having an exterior face presented outwardly of a piling being driven and an interior face securable to the piling exterior;

b. a pivot bracket supported upon the exterior face of said backing plate, so as to extend laterally outwardly thereof;

c. a pivoting arm complementally engaging said pivot bracket and pivotably secured thereto by means of a pivot pin extending through said pivoting arm and said pivot bracket;

d. a thrust plate supported upon said pivoting arm, so as to be pivotable upwardly to a mode of substantial alignment with a piling being driven and pivotable downwardly, so as to extend laterally outward of said piling in a locking mode, as the piling is set.

2. A piling anchor as in claim 1, including bolt securement means extending through-said backing plate into said piling.

3. A piling anchor as in claim 2 in combination with and secured to a piling.

4. A piling anchor as in claim 2, including a locking pin extensible through said pivoting arm and said pivot bracket, so as to secure said thrust plate in an attitude laterally outwardly of said backing plate.

5. A piling anchor as in claim 4, said locking pin being in the form of a spring urged detent secured to a side of said pivot bracket, so as to be extensible through an aligned aperture in said pivoting arm.

6. A piling anchor as in claim 5, said backing plate having a curvate cross-section complementally to the entire surface of the piling being driven.

7. A piling anchor as in claim 6, said thrust plate in the mode of substantial alignment with the piling being approximately 8° offset with respect to the vertical axis of the piling being driven.

8. A pivling anchor as in claim 7, said pivot bracket being bifurcated as a guide on both sides of said pivoting arm and extending laterally outwardly beneath said thrust plate in its laterally outward locking mode.

9. A piling anchor as in claim 8, said pivoting arm being in the form of a triangle with a first vertical side abutting the thrust plate bottom and at right angles to a second vertical side abutting said backing plate.

10. A piling anchor as in claim 9, said pivoting arm including a rounded elbow extending between said first vertical side and said second vertical side, as an assistance in pivoting downwardly said pivoting arm from the thrust plate mode of substantial alignment to the outwardly extending locking mode.

* * * * *